US010788263B1

(12) United States Patent
Clearman et al.

(10) Patent No.: US 10,788,263 B1
(45) Date of Patent: Sep. 29, 2020

(54) DRYING, SPACE-SAVING SOAP BAR CONTAINER METHODS, SYSTEMS, AND DEVICES

(71) Applicant: Clearman Labs, LLC, Boulder, CO (US)

(72) Inventors: Christopher Aaron Clearman, Boulder, CO (US); Jaime Lynn Caso, Boulder, CO (US)

(73) Assignee: Clearman Labs, LLC, Boulder, CO (US)

( * ) Notice: Subject to any disclaimer, the term of this patent is extended or adjusted under 35 U.S.C. 154(b) by 24 days.

(21) Appl. No.: 16/278,130

(22) Filed: Feb. 17, 2019

Related U.S. Application Data

(60) Provisional application No. 62/631,732, filed on Feb. 17, 2018.

(51) Int. Cl.
*F26B 5/04* (2006.01)
*F26B 25/16* (2006.01)

(52) U.S. Cl.
CPC ..... *F26B 5/04* (2013.01); *F26B 25/16* (2013.01)

(58) Field of Classification Search
CPC ..... F26B 5/00; F26B 5/04; F26B 5/06; F26B 25/00; F26B 25/10; A61J 1/00; A61J 1/145; A61J 1/1456; A61J 1/1468; A61F 9/0008
USPC ..... 34/305
See application file for complete search history.

(56) References Cited

U.S. PATENT DOCUMENTS 1,659,644 A * 2/1928 Waldemar ..... A47K 5/03 248/346.11
1,854,415 A * 4/1932 Miller ..... A47K 7/03 401/201
3,738,276 A * 6/1973 Picard ..... B65D 81/18 102/401
4,278,719 A * 7/1981 Sarnecki ..... A47G 9/062 428/78
4,422,546 A * 12/1983 Charity ..... A47K 7/03 15/244.4
4,874,618 A * 10/1989 Seaborne ..... A23G 9/04 426/76
5,279,412 A * 1/1994 Lee ..... A47K 5/03 206/77.1

(Continued)

FOREIGN PATENT DOCUMENTS

CA 2904983 A1 * 9/2014 ..... A61F 13/51405
EP 2968031 B1 * 4/2017 ..... A61F 13/51113
JP 6130042 B2 * 5/2017 ..... A47L 13/17

*Primary Examiner* — Stephen M Gravini
(74) *Attorney, Agent, or Firm* — Wilson Patent Law, LLC

(57) ABSTRACT

Methods, systems, and devices for a lightweight, space-saving soap bar container that may allow contents to dry while in storage are provided in accordance with various embodiments. The tools and techniques in accordance with various embodiments may provide for a lightweight, space saving container that may contain bar soap for travel, backpacking, camping, and recreational activities, for example. The container may allow a wet soap bar to dry while in storage, which may avoid a soggy soap bar that can be an unpleasant experience for the user and reduce the lifespan and quality of the soap. It also may contain soap and wet soapy residue from the soap bar to prevent the soap and residue from getting on other objects during travel. Lastly, the container may be able to change size as the soap bar changes size, allowing maximum portability.

20 Claims, 8 Drawing Sheets

(56) References Cited

U.S. PATENT DOCUMENTS

| | | | | | |
|---|---|---|---|---|---|
| D367,322 | S | * | 2/1996 | Parker | D32/42 |
| 5,704,723 | A | * | 1/1998 | Salisian | A47K 7/03 401/201 |
| 5,804,260 | A | * | 9/1998 | Stafford | A47K 5/03 428/15 |
| 5,914,154 | A | * | 6/1999 | Nemser | A61L 9/16 427/235 |
| 6,623,830 | B2 | * | 9/2003 | Lewis | A47K 5/03 206/77.1 |
| 6,745,763 | B2 | * | 6/2004 | Webb | B05B 11/0072 128/203.12 |
| 7,265,258 | B2 | * | 9/2007 | Hamilton | A61F 13/15 604/364 |
| 7,971,755 | B2 | * | 7/2011 | Faurie | B65D 47/18 222/189.09 |
| 9,068,694 | B2 | * | 6/2015 | Woodward | B67B 6/00 |
| 9,205,006 | B2 | * | 12/2015 | Cheng | A61F 13/53 |
| 10,335,812 | B2 | * | 7/2019 | Vellutato, Jr. | B05B 11/0081 |
| D867,161 | S | * | 11/2019 | Clearman | D9/708 |
| 2011/0052305 | A1 | * | 3/2011 | Leros | A47L 1/15 401/137 |

* cited by examiner

DRYING, SPACE-SAVING SOAP BAR CONTAINER METHODS, SYSTEMS, AND DEVICES

CROSS-REFERENCES TO RELATED APPLICATIONS

This application is a non-provisional patent application claiming priority benefit of U.S. provisional patent application Ser. No. 62/631,732 filed on Feb. 17, 2018 and entitled "DRYING, SPACE-SAVING SOAP BAR CONTAINER," the entire disclosure of which is herein incorporated by reference for all purposes.

BACKGROUND

There are generally a number of soap bar containers for use while traveling, backpacking, and/or engaging in recreational activities, for example. The containers generally protect the soap bar from coming into contact with other items it is packed with (in luggage, for example) and from rubbing soapy film onto the user's other objects.

Traditional soap bar containers generally are made from a resilient material and have a resilient structure. This generally means the containers retain the same shape whether empty or full. As a result, the user may be forced to carry a container that is the same size regardless of the size of the bar soap inside. The resilient material and resilient structure of traditional containers may involve the use of relatively heavy materials and relatively thick container walls, which may result in a heavy product that may not change its exterior volume as the volume of the contents inside is changed.

The resilient materials used in the construction of traditional soap bar containers may also be impermeable to liquid and vapor. Therefore, when a wet soap bar may be placed into the container after use, it generally remains wet, which may be a viscerally unpleasant experience for the user the next time they open the container to use their soap; leaving the soap bar wet within a container may also cause the soap bar to soften and reduce the lifespan and/or quality of the soap bar. To combat this issue, vents or holes may sometimes be put in the cases to aide in drying, but these may allow water, liquified soap, and generally wet/messy contents to escape from the case.

Because it may be desirable to carry as little bulk and weight as possible when traveling, backpacking, camping, or engaging in recreational activities, the heavy and bulky design of the traditional soap bar container may be undesirable. There thus may be a need for tools and techniques that may address these issues found with some traditional soap bar containers.

SUMMARY

Methods, systems, and devices for a lightweight, space-saving soap bar container that may allow contents to dry while in storage are provided in accordance with various embodiments. The tools and techniques in accordance with various embodiments may provide for a lightweight, space saving container that may contain soap bar for travel, backpacking, camping, and recreational activities, for example. The container may allow a wet soap bar to dry while in storage, which may avoid a soggy soap bar that can be an unpleasant experience for the user and reduce the lifespan and quality of the soap. It also may contain soap and wet soapy residue from the soap bar to prevent the soap and residue from getting on other objects during travel. Lastly, the container may be able to change size as the soap bar changes size, allowing maximum portability.

For example, some embodiments include a method that may include: inserting a soap bar that is wet through an opening into a container, wherein the container includes one or more vapor-permeable layers; closing the opening of the container; and/or drying the soap bar through water vapor passing through the one or more vapor permeable layers of the container.

In some embodiments, closing the opening of the container includes: folding a portion of the container that includes the opening of the container to form a fold-top closure; and/or coupling a first buckle component coupled with the container with a second buckle component coupled with the container to maintain the fold-top closure. Some embodiments include removing the soap bar from the container after the soap bar has dried. In some embodiments, the fold-top closure includes one or more semi-rigid structural members to form a liquid-tight barrier.

In some embodiments, the one or more vapor-permeable layers include one or more flexible laminar sheets. The one or more flexible laminar sheets may include one or more thermoplastic urethane coated fabrics. The one or more thermoplastic urethane coated fabrics may include one or more polyether-based thermoplastic urethane coated fabrics.

In some embodiments, the one or more polyether-based thermoplastic urethane coated fabrics is configured to contain a wet residue of the soap bar within the container. The one or more vapor-permeable layers may include one or more non-resilient layers.

In some embodiments, the one or more vapor-permeable layers include a first layer and a second layer that are bonded with each other along a first side of the first layer and a first side of the second layer and along a second side of the first layer and a second side of the second layer. The one or more vapor-permeable layers may include a third layer that forms a gusset component of the container between a third side of the first layer and a third side of the second layer. In some embodiments, the first layer of the container and the second layer of the container are bonded with each other to form a flatten configuration before the soap bar that is wet is placed within the container. In some embodiments, the first layer of the container and the second layer of the container are limited to a length of 18 centimeters or and a width of 12.5 centimeters or less. In some embodiments, the first layer of the container and the second layer of the container each have a length between 14 centimeters and 16 centimeters and a width between 9 centimeters and 11 centimeters. In some embodiments, the container forms a total volume between 200 milliliters and 300 milliliters.

In some embodiments, the container is configured with respect to one or more vapor-permeable layers such that drying the soap bar occurs in less than 24 hours. In some embodiments, the one or more vapor-permeable layers include one or more water-proof layers.

In some embodiments, the one or more vapor-permeable layers includes an external hydrophobic coating. The external hydrophobic coating may include a durable water repellant (DWR). In some embodiments, the one or more polyether-based thermoplastic urethane coated fabrics are configured such that a polyether-based thermoplastic urethane coating coats an internal layer of the one or more fabrics.

Some embodiments include methods, systems, and/or devices as described in the specification and/or shown in the figures.

The foregoing has outlined rather broadly the features and technical advantages of embodiments according to the disclosure in order that the detailed description that follows may be better understood. Additional features and advantages will be described hereinafter. The conception and specific embodiments disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of different embodiments may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

This description provides embodiments, and is not intended to limit the scope, applicability, or configuration of the disclosure. Rather, the ensuing description will provide those skilled in the art with an enabling description for implementing embodiments of the disclosure. Various changes may be made in the function and arrangement of elements.

Thus, various embodiments may omit, substitute, or add various procedures or components as appropriate. For instance, it should be appreciated that the methods may be performed in an order different than that described, and that various stages may be added, omitted or combined. Also, aspects and elements described with respect to certain embodiments may be combined in various other embodiments. It should also be appreciated that the following systems, devices, and methods may individually or collectively be components of a larger system, wherein other procedures may take precedence over or otherwise modify their application.

Methods, systems, and devices for a lightweight, space-saving bar soap container that may allow contents to dry while in storage are provided in accordance with various embodiments. The tools and techniques in accordance with various embodiments may provide for a lightweight, space saving container that may contain bar soap for travel, backpacking, camping, and recreational activities, for example. The container may allow a wet soap bar to dry while in storage, which may avoid a soggy soap bar that can be an unpleasant experience for the user and reduce the lifespan and quality of the soap. It also may contain soap and wet soapy residue from the soap bar to prevent the soap and residue from getting on other objects during travel. Lastly, the container may be able to change size as the soap bar changes size, allowing maximum portability.

These tools and techniques may address a need for a lighter, space saving container for containing bar soap that adjusts its size and volume based on the size and volume of the bar soap inside. The devices, systems, and methods described herein may provide for containing bar soap that may be space-saving and may have the ability to dry a wet soap bar in storage without getting soapy residue on exterior items.

Figure 1A:
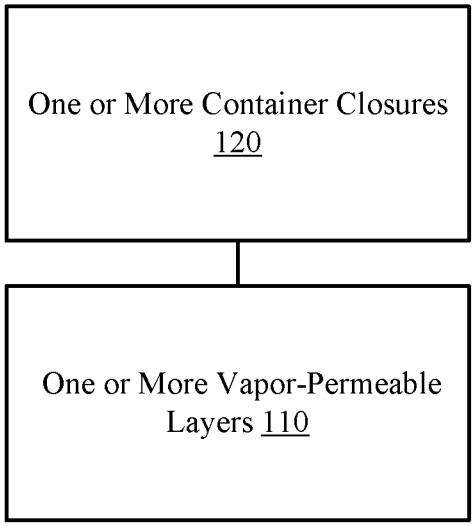
FIG. 1A shows a device in accordance with various embodiments.

Turning now to FIG. 1A, a device 100 is provided in accordance with various embodiments. Device 100 may be referred to as a container or a soap bar container; for example, the device 100 may be referred to as a drying, space-saving soar bar container in some embodiments. In some embodiments, device 100 may be referred to as a soap bag. Device 100 may include a packet, bag, or bottle for containing bar soap. The structure of device 100 generally may not be resilient, meaning that it may not hold its own shape or return to a pre-determined shape when compressed or deformed; for example, the structure of device 100 may allow for folding, flexing, and/or flattening. In particular, device 100 may include one or more container closures 120 and one or more vapor-permeable layers 110.

The one or more vapor-permeable layers 110 may include a material that allows the escape of water and other fluids in vapor form, though not in bulk liquid form. In some embodiments, device 100 is formed from elastomeric material. In some embodiments, the one or more vapor-permeable layers 110 include one or more flexible laminar sheets. In some embodiments, device 100 is constructed from one or more pieces (sheets/panels) of a flexible laminar material. In some embodiments, the laminar material is made of fabric, plastic, elastomer, or any combination of the three. The panel or panels may be welded, sewn, glued, taped, or otherwise adhered or bonded to form a cavity in which a soap bar could be stored. In some embodiments, a laminar material may be used to construct a baffled structure to increase the volumetric capacity of the container.

The one or more flexible laminar sheets may include one or more thermoplastic urethane coated fabrics. The one or more thermoplastic urethane coated fabrics may include one or more polyether-based thermoplastic urethane coated fabrics. In some embodiments, the one or more polyether-based thermoplastic urethane coated fabrics are configured to contain a wet residue of the soap bar within the container 100. In some embodiments, this fabric is nylon or polyester. A variety of constructions techniques may be utilized including spraying on the coatings, rolling on the coatings, and/or heating on the coatings.

In some embodiments, the one or more vapor-permeable layers 110 include a first layer and a second layer that are bonded with each other along a first side of the first layer and a first side of the second layer and along a second side of the first layer and a second side of the second layer. The one or more vapor-permeable layers 110 may include a third layer that forms a gusset component of the container 100 between a third side of the first layer and a third side of the second layer. In some embodiments, the first layer of the container 100 and the second layer of the container 100 are bonded with each other to form a flatten configuration before the soap bar that is wet is placed within the container 100. A variety of bonding techniques may be utilized such as sonic bonding, heat bonding, and/or adhesive bonding.

In some embodiments, the first layer of the container 100 and the second layer of the container 100 are limited to a length of 18 centimeters or less and a width of 12.5 centimeters or less. In some embodiments, the first layer of the container 100 and the second layer of the container 100 each have a length between 14 centimeters and 16 centimeters and a width between 9 centimeters and 11 centimeters. In some embodiments, the container 100 forms a total volume between 200 milliliters and 300 milliliters; for example, some embodiments may form a total volume of approximately 250 milliliters. These sizes are provided merely as examples of various embodiments; some embodiments may utilize widths, lengths, or volumes besides these values provided.

In some embodiments, the container 100 is configured with respect to one or more vapor-permeable layers 110 such that drying the soap bar occurs in less than 24 hours. In some embodiments, the one or more vapor-permeable layers 100 include one or more water-proof layers.

In some embodiments, the one or more vapor-permeable layers 100 includes an external hydrophobic coating. The external hydrophobic coating may include a durable water repellant (DWR). Other hydrophobic coatings may include silicone, to form a siliconized fabric, for example. In some embodiments, the one or more polyether-based thermoplastic urethane coated fabrics are configured such that a polyether-based thermoplastic urethane coating coats an internal layer of the one or more fabrics.

In some embodiments, the one or more container closures 120 include one or more closeable openings on system 100 to insert or to remove bar soap. In some embodiments, the one or more container closures 120 may include one or more closure mechanisms for the one or more openings on device 100. This closure mechanism may include a roll-top, buckle, snap, zipper, fold/slide mechanism, and/or other mechanical closure. A roll-top closure may also be referred to as a fold-top closure.

In some embodiments, a roll-top closure may include a secondary device used to aid the closing of system 100, such as a buckle or snap. In some embodiments, the mechanical closure device may be attached to the container 100 using a laminar material that is attached to one or more sides of the container's opening. In some embodiments, the roll-top/fold-top closure may include a semi-rigid structural member (stiff but flexible) on one or more sides of the opening to ensure a liquid-tight barrier when in the closed position.

In some embodiments, there are alternative container closures 120 for the opening in device 100. These alternative closure methods include, but are not limited to, hook-and-loop, interlocking zipper structures (zip-lock style or traditional tooth zipper or coil zipper style), mechanical interlocks, draw strings, temporary adhesive (sticky) closures, etc.

In some embodiments, device 100 may include a laminar protrusion from a welded seam. This laminar protrusion may contain space to indicate container contents or other information. This indicator portion may be screen printing, writing the contents, color-coding, or other indicators.

In some embodiments, device 100 may include a tether, hole, or other means to hang the container or otherwise attach it to extraneous objects. In some embodiments, this hole may accept a keyring, buckle, snap, or carabiner for hanging or attachment. In some embodiments, the tether is a flexible laminar material arranged to form a loop for hanging or attaching the container 100. The loop may be permanently attached to the container 100 or fully removable. The removable loop may be attached to the container 100 or to itself with a mechanical attachment mechanism including but not limited to a buckle, button snap, sewing, or hook-and-loop so that it can be easily opened and closed by the user as desired, allowing for easier attachment in some instances. In some embodiments the tether is permanently attached at one end but can be detached on the other end to enable easy attachment to extraneous objects.

Figure 1B:
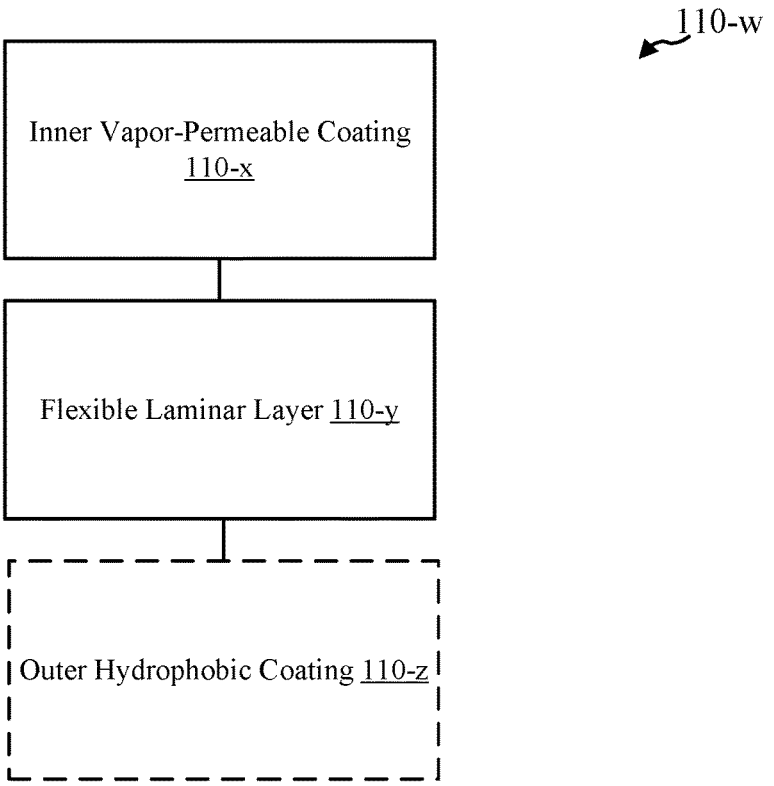
FIG. 1B shows aspects of a device in accordance with various embodiments.
Figure 1C:
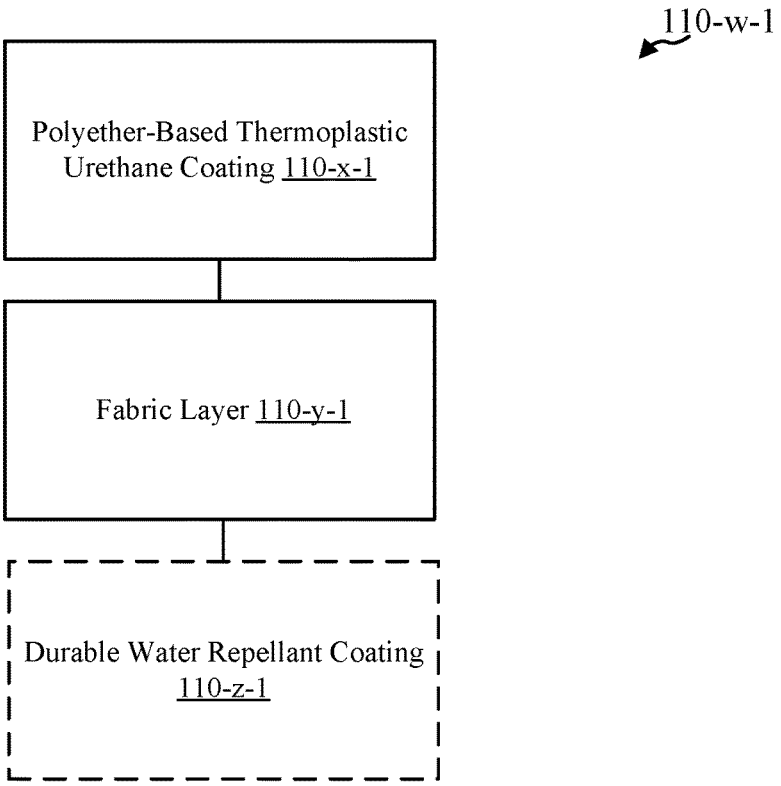
FIG. 1C shows aspects of a device in accordance with various embodiments.

FIG. 1B and FIG. 1C provide examples of vapor-permeable layers 110-*w* and 110-*w*-1 respectively, which may be utilized in accordance with various embodiments and may be examples of the one or more vapor-permeable layers 110 of FIG. 1A. For example, FIG. 1B shows a vapor-permeable layer 110-*w* that may be constructed from multiple layers and/or coatings. For example, the vapor-permeable layer 110-*w* may include a flexible laminar layer 110-*y* along with an inner vapor-permeable coating 110-*x*. Each layer or coating, in general, may be vapor-permeable, while some layers or coatings may also provide water-proofing. The inner vapor-permeable coating 110-*x* may also be referred to as the soap-side layer or coating.

In some embodiments, the inner vapor-permeable coating 110-*x* may include thermoplastic urethane coating. The thermoplastic urethane coating may include a polyether-based thermoplastic urethane coatings. In some embodiments, the polyether-based thermoplastic urethane coating is configured to contain a wet residue of the soap bar within a soap container, such as soap container 100 of FIG. 1A. In some embodiments, this flexible laminar layer 110-*y* may include a fabric, such as a nylon or polyester fabric. A variety of constructions techniques may be utilized including spraying on the coatings, rolling on the coatings, and/or heating on the coatings.

Optionally, some embodiments of vapor-permeable layer 110-*w* may include an outer hydrophobic coating or layer 110-*z*. This outer coating 110-*z* may be vapor-permeable, while hindering liquid water in a non-vapor state from permeating the layer 110-*w*. For example, this outer hydrophobic coating 110-*z* may include a Durable Water Repellant (DWR) coating. Other embodiments may utilize a silicone coating.

FIG. 1C shows a specific example of a vapor-permeable layer 110-*w*-1 constructed from an inner polyether-based thermoplastic urethane coating 110-*x*-1 that may be applied or otherwise brought together with a fabric layer 110-*y*-1. An outer hydrophobic coating, such as Durable Water Repellant (DRW) coating 110-*z*-1 may be applied or otherwise brought together with the fabric layer 110-*y*-1 to form the overall vapor-permeable layer construction.

The construction of vapor-permeable layers 110-*w* and/or 110-*w*-1 may allow the escape of water and other fluids in vapor form, though not in bulk liquid form. This may allow for the drying of a soap bar within a soap bar container, such as container 100 of FIG. 1A, while keeping bulk liquid water from entering or bulk liquid and/or soap residue from exiting the soap container. Furthermore, these constructions may allow for a soap bar to dry within the soap container in less than a 24 hour period. While thermoplastic urethane coatings are typically not considered vapor permeable, this is generally because their vapor transport rate may be quite slow. However, it was unexpectedly realized that in various embodiments provided, it was possible to get these desired vapor-permeable properties for soap bar containers utilizing thermoplastic urethane coatings, such as coatings 110-*x* or 110-*x*-1. In particular, the thickness of the thermoplastic urethane coating may be relevant to facilitate the vapor permeable aspect and allow for the desired soap drying within the soap bar container. Merely by way example, the thickness of coatings such as 110-*x* or 110-*x*-1 may be between 0.05 millimeters and 0.23 millimeters. Challenges may arise in trying to weld the layers together below this range, while coatings thicker than this range may result in drying time issues. In some embodiments, the thickness of coatings 110-*x* or 110-*x*-1 may be approximately 0.13 millimeters (+/−0.01 millimeters). Some embodiments may have coatings that fall between 0.08 millimeters and 0.20 millimeters. Some embodiments utilize polyether-based thermoplastic urethane because it may be more chemically compatible for the soap bar containers provided; for example, polyether-based thermoplastic urethane may be more stable in the presence of water exposure and/or the other ingredients commonly found in soap (sodium chloride, citric acid, sodium bicarbonate, etc.) In contrast, polyester-based thermoplastic urethane may not be as appropriate for some embodiments as it may degrade with long-term exposure to water and/or other ingredients commonly found in soaps.

Figure 2A:
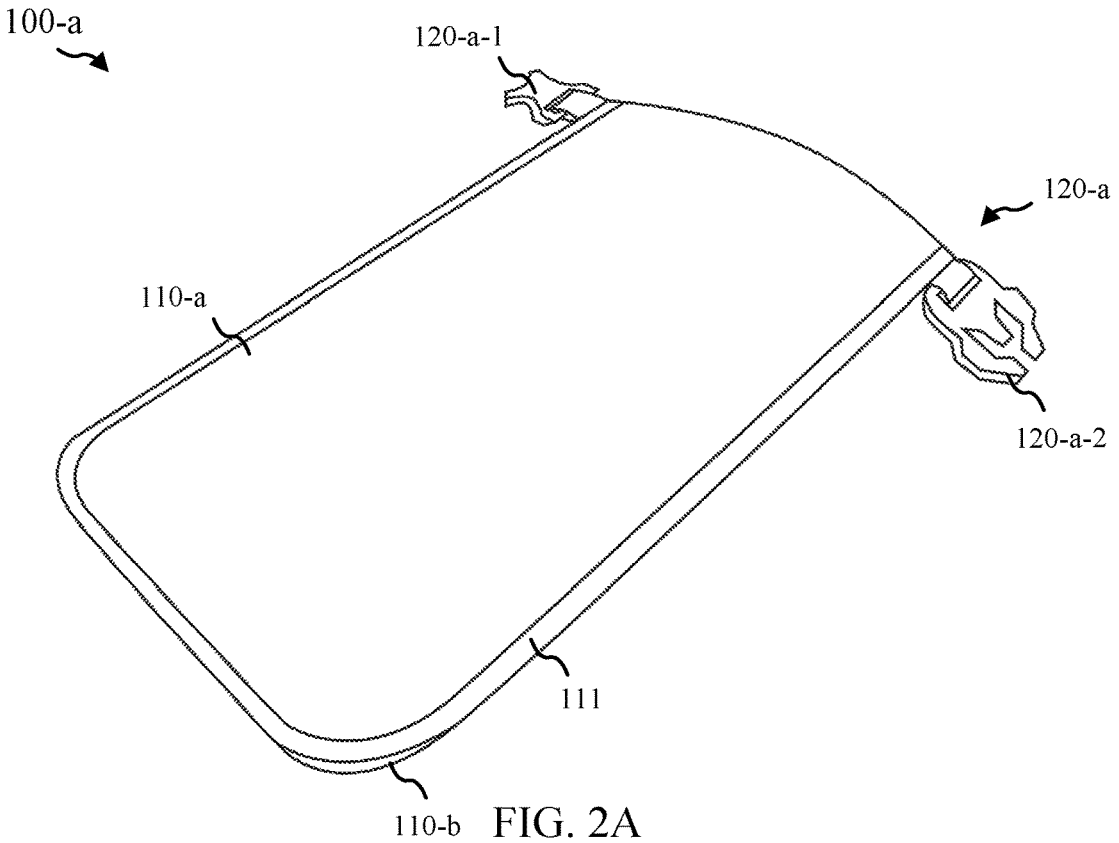
FIG. 2A shows a device in accordance with various embodiments.
Figure 2B:
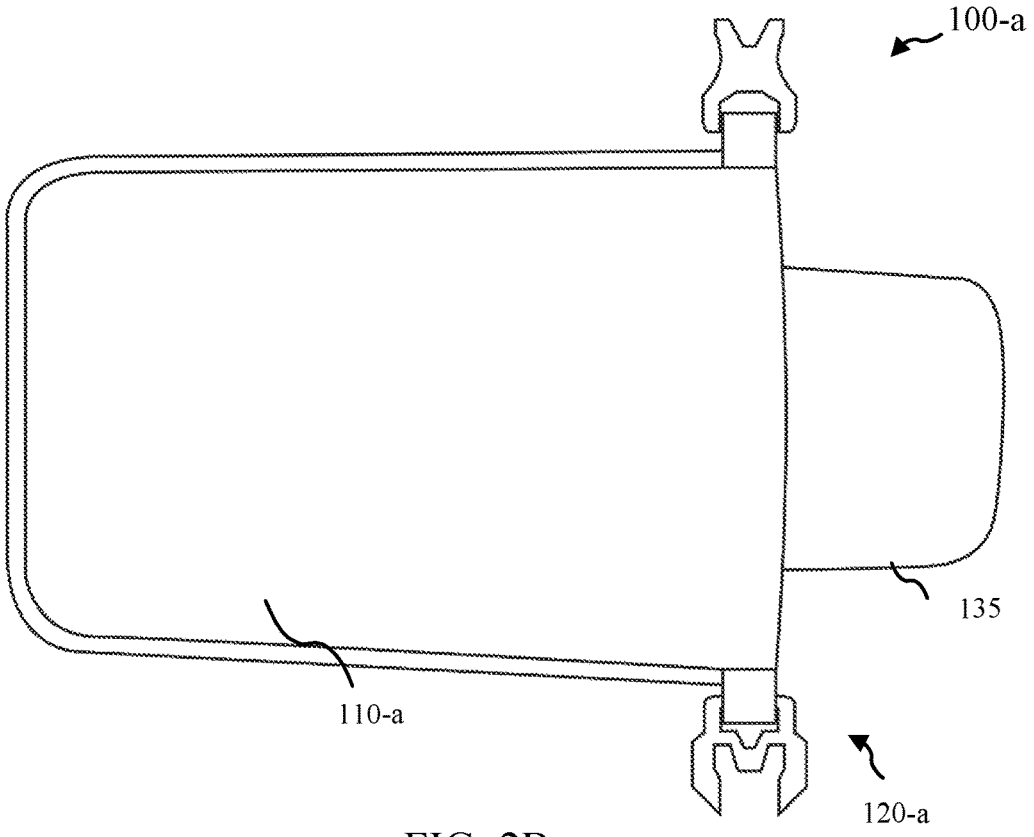
FIG. 2B shows a device in accordance with various embodiments.
Figure 2C:
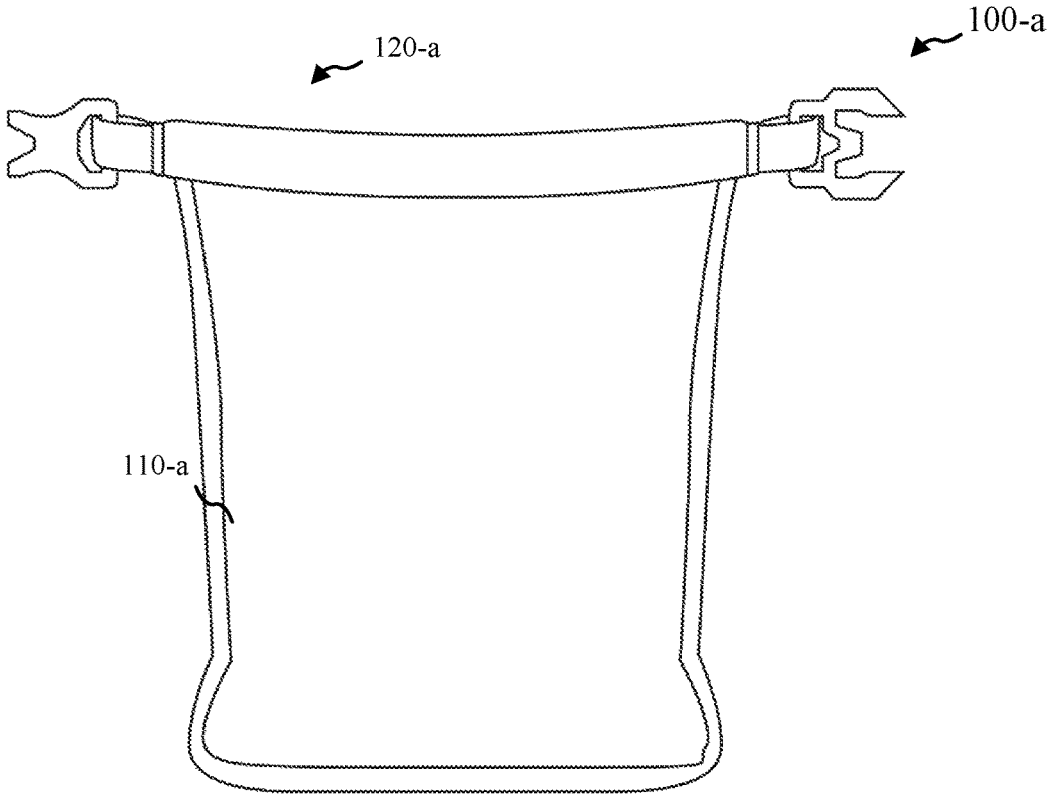
FIG. 2C shows a device in accordance with various embodiments.
Figure 2D:
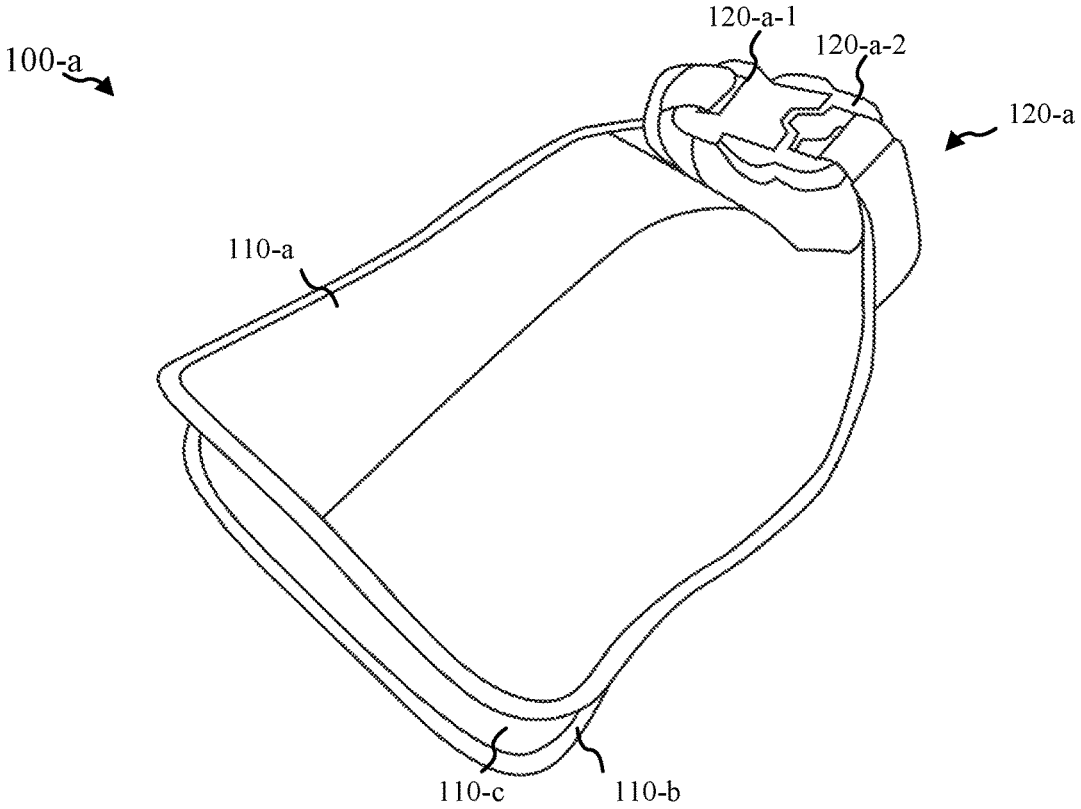
FIG. 2D shows a device in accordance with various embodiments.

Turning now to FIG. 2A, FIG. 2B, FIG. 2C, and FIG. 2D, aspects of a soap bar container 100-*a* in accordance with various embodiments are provided. Container 100-*a* may be an example of container 100 of FIG. 1. Container 100-*a* may include multiple vapor permeable layers 110-*a*, 110-*b*, 110-*c* and one or more container closures 120-*a*. In particular, container 100-*a* may be configured with a roll-top/fold-top closure with two buckle component 120-*a*-1, 120-*a*-2 as part of the one or more closure components 120-*a*; the two buckle component 120-*a*-1, 120-*a*-2 may mate with each other to facilitate closing the container 100-*a*. Container 100-*a* may also show one or more bonded edges 111, where one or more layers, such as layers 110-*a* and 110-*b* may be bonded together; the bonding may be configured to facilitate providing a flattenable configuration for container 100-*a*. Layers 110-*a*, 110-*b*, and 110-*c* may be examples of the one or more vapor-permeable layers 110 of FIG. 1A, vapor-permeable layer 110-*w* of FIG. 1B, and/or vapor-permeable layer 110-*w*-1 of FIG. 1C. FIG. 2A may show container 100-*a* as soap bar container without contents (i.e., flat configuration). FIG. 2B may show bar soap 135 being inserted into an opening of container 100-*a* with respect to the one or more container closures 120-*a* in accordance with various embodiments. FIG. 2C may show container 100-*a* in an expanded configuration, with soap bar contained inside; the roll-top/fold-top closure 120-*a* may be in the process of being rolled or folded down based on the size of the soap bar inside the container 100-*a*. FIG. 2D may show the vapor-permeable layer 110-*c* formed as a gusset component, which may facilitate the expanded configuration. FIG. 2D also shows the container closure 120-*a* such that the bucket components 120-*a*-1 and 120-*a*-2 have been mated with each other to complete the roll down/fold down and closure process to contain the soap bar within the container 100-*a*. As the soap bar may reduce in size over time, the amount of roll down/fold down may increase to compensate for the size change of the soap bar. In some embodiments, the container 100-*a* may be tapered from the top portion that may include the container closure 120-*a* to the bottom portion that may include the gusset component 110-*c*.

The container 100-*a* may have a length between 14 centimeters and 16 centimeters and a width between 9 centimeters and 11 centimeters; for example. The width of container 100-*a* may have a length of approximately 15 centimeters and width of approximately 10 centimeters (+/−0.5 centimeters). In some embodiments, the container 100-*a* forms a total volume between 200 milliliters and 300 milliliters; for example, some embodiments may form a total volume of approximately 250 milliliters (+/−10 milliliters).

Figure 3A:
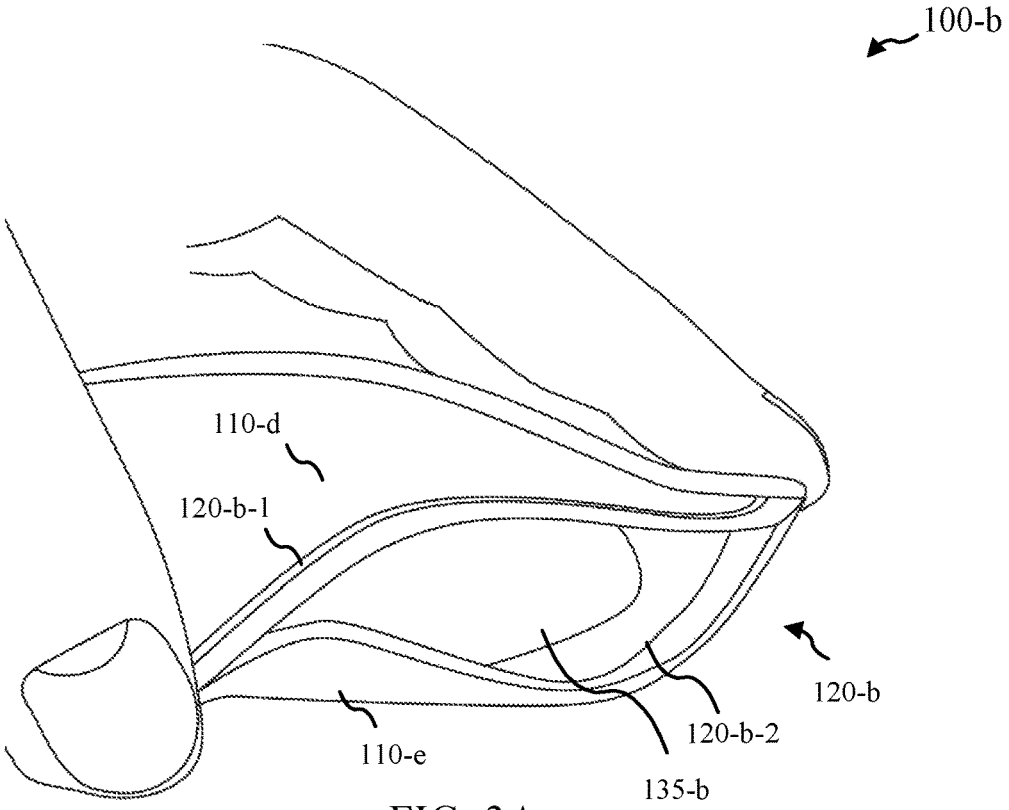
FIG. 3A shows a device in accordance with various embodiments.
Figure 3B:
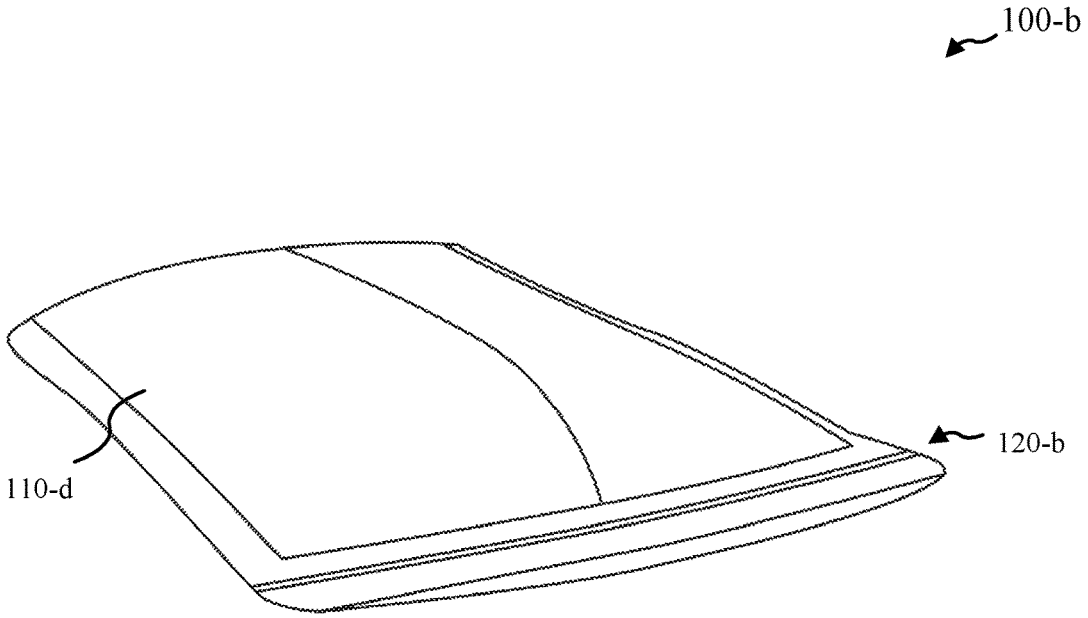
FIG. 3B shows a device in accordance with various embodiments.

FIG. 3A and FIG. 3B show aspects of a soap bar container 100-*b* in accordance with various embodiments. Container 100-*b* may be an example of container 100 of FIG. 1. FIG. 3A may show container 100-*b* in an open state, with a soap bar 135-*b* placed within container 100-*b*, while FIG. 3B may show container 100-*b* in a closed state. Container 100-*b* may include multiple vapor-permeable layers 110-*d*, 110-*e* and one or more container closures 120-*b*. The one or more container closures 120-*b* may be configured as an interlocking zip-lock closure, where an interlocking groove 120-*b*-1 and ridge 120-*b*-2 that may form a tight seal when pressed together. Layers 110-*d* and 110-*e* may be examples of the one or more vapor-permeable layers 110 of FIG. 1A, vapor-permeable layer 110-*w* of FIG. 1B, and/or vapor-permeable layer 110-*w*-1 of FIG. 1C.

Figure 4A:
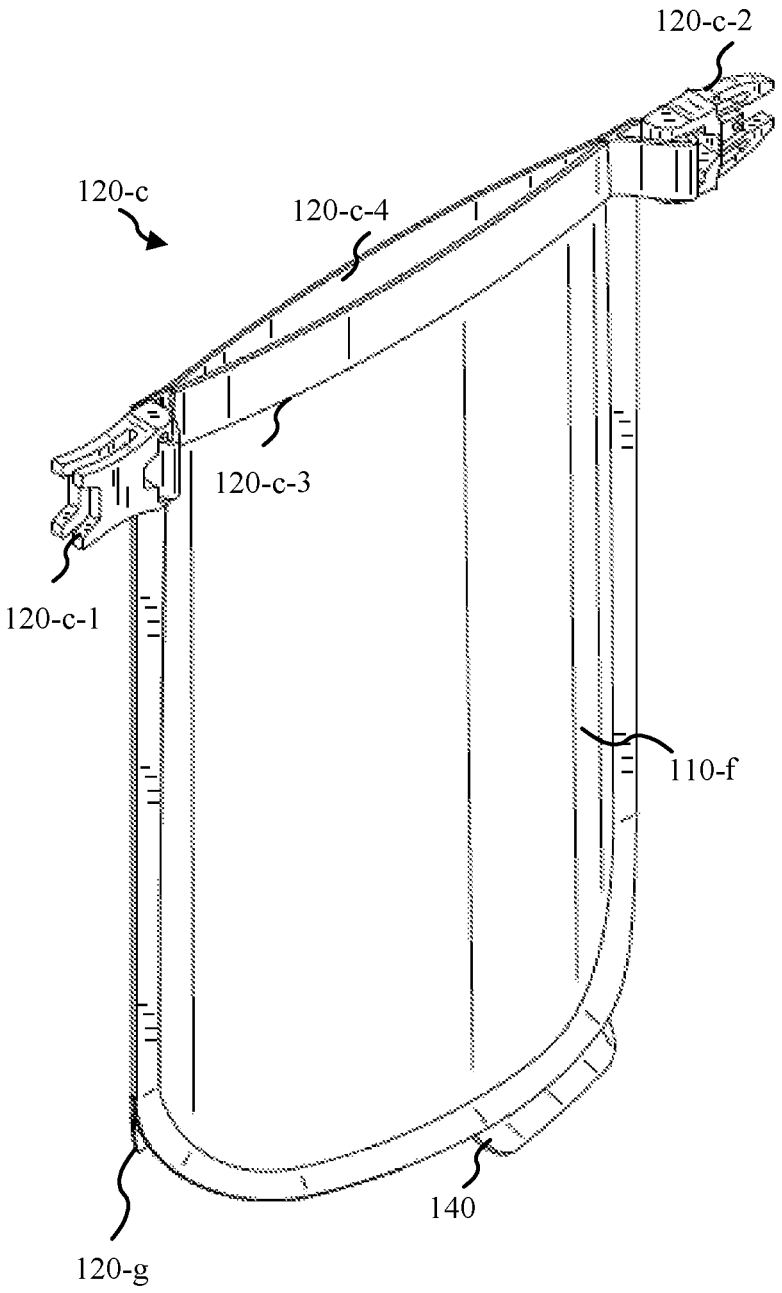
FIG. 4A shows a device in accordance with various embodiments.
Figure 4B:
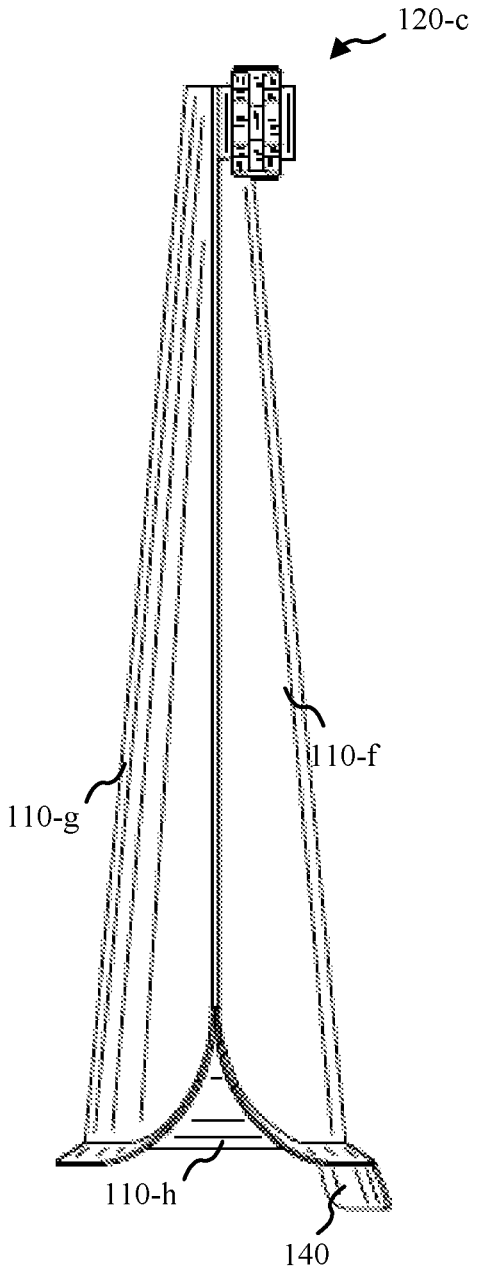
FIG. 4B shows a device in accordance with various embodiments.

FIG. 4A and FIG. 4B show different views of a soap bar container 100-*c* in accordance with various embodiments. Container 100-*c* may be an example of device 100 of FIG. 1. FIG. 4A may provide a perspective view of container 100-*c*, while FIG. 4B may provide a side view. Container 100-*c* may include one or more vapor permeable layers 110-*f*, 110-*g*, 110-*h* and one or more container closures 120-*c*; layers 110-*f* and 110-*g* may form front and back sides of the container 100-*c*, while layer 110-*h* may form a bottom or gusset. Container 100-*c* may be configured with a roll-top/fold-top container closure 120-*c* with two buckle components 120-*c*-1, 120-*c*-2 as part of the one or more container closure 120-*c*. Some embodiments include a protrusion 140 from a seam. This protrusion 140 may be used to indicate contents or other information about the container 100-*c*. The roll-top/fold-top container closure 120-*c* may include one or more semi-rigid structural members 120-*c*-3, 120-*c*-4, which may help form a liquid-tight barrier. Layers 110-*f*, 110-*g*, and 110-*h* may be examples of the one or more vapor-permeable layers 110 of FIG. 1A, vapor-permeable layer 110-*w* of FIG. 1B, and/or vapor-permeable layer 110-*w*-1 of FIG. 1C.

Figure 5:
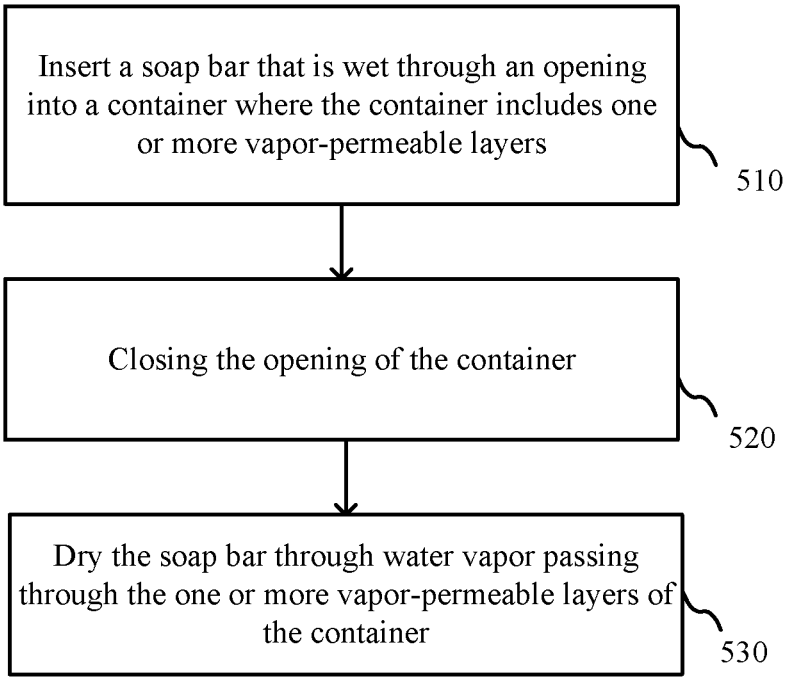
FIG. 5 shows a flow diagram of a method in accordance with various embodiments.

Turning now to FIG. 5, a flow diagram of a method 500 is shown in accordance with various embodiments. Method 500 may be implemented utilizing a variety of devices and/or components such as those shown and/or described with respect to FIG. 1A, FIG. 1B, FIG. 1C, FIG. 2A, FIG. 2B, FIG. 2C, FIG. 2D, FIG. 3A, FIG. 3B, FIG. 4A, and/or FIG. 4B.

At block 510, a soap bar that is wet may be inserted through an opening into a container; the container may include one or more vapor-permeable layers. At block 520, the opening of the container may be closed. At block 530, the soap bar may dry through water vapor passing through the one or more vapor permeable layers of the container.

In some embodiments of method 500, closing the opening of the container includes: folding a portion of the container that includes the opening of the container to form a fold-top closure; and/or coupling a first buckle component coupled with the container with a second buckle component coupled with the container to maintain the fold-top closure. Some embodiments include removing the soap bar from the container after the soap bar has dried. Some embodiments may include changing the size of the container as the soap bar changes size, such as further folding or rolling the fold-top closure based on the soap bar size change. The folding and fold-top closure may also be referred to as rolling and roll-top closure.

In some embodiments of method 500, the one or more vapor-permeable layers include one or more flexible laminar sheets. The one or more flexible laminar sheets may include one or more thermoplastic urethane coated fabrics. The one or more thermoplastic urethane coated fabrics may include one or more polyether-based thermoplastic urethane coated fabrics. In some embodiments, the fold-top closure includes one or more semi-rigid structural members to form a liquid-tight barrier.

In some embodiments of method 500, the one or more polyether-based thermoplastic urethane coated fabrics is configured to contain a wet residue of the soap bar within the container. The one or more vapor-permeable layers may include one or more non-resilient layers.

In some embodiments of method 500, one or more vapor-permeable layers include a first layer and a second layer that are bonded with each other along a first side of the first layer and a first side of the second layer and along a second side of the first layer and a second side of the second layer. The one or more vapor-permeable layers may include a third layer that forms a gusset component of the container between a third side of the first layer and a third side of the second layer. In some embodiments, the first layer of the container and the second layer of the container are bonded with each other to form a flatten configuration before the soap bar that is wet is placed within the container. In some embodiments, the first layer of the container and the second layer of the container are limited to a length of 18 centimeters or less and a width of 12.5 centimeters or less. In some embodiments, the first layer of the container and the second layer of the container each have a length between 14 centimeters and 16 centimeters and a width between 9 centimeters and 11 centimeters. In some embodiments, the container forms a total volume between 200 milliliters and 300 milliliters.

In some embodiments of method 500, the container is configured with respect to one or more vapor-permeable layers such that drying the soap bar occurs in less than 24 hours. In some embodiments, the one or more vapor-permeable layers include one or more water-proof layers.

In some embodiments of method 500, the one or more vapor-permeable layers includes an external hydrophobic coating. The external hydrophobic coating may include a durable water repellant (DWR). In some embodiments, the one or more polyether-based thermoplastic urethane coated fabrics are configured such that a polyether-based thermoplastic urethane coating coats an internal layer of the one or more fabrics.

These embodiments may not capture the full extent of combination and permutations of materials and process equipment. However, they may demonstrate the range of applicability of the method, devices, and/or systems. The different embodiments may utilize more or less stages than those described.

It should be noted that the methods, systems, and devices discussed above are intended merely to be examples. It must be stressed that various embodiments may omit, substitute, or add various procedures or components as appropriate. For instance, it should be appreciated that, in alternative embodiments, the methods may be performed in an order different from that described, and that various stages may be added, omitted or combined. Also, features described with respect to certain embodiments may be combined in various other embodiments. Different aspects and elements of the embodiments may be combined in a similar manner. Also, it should be emphasized that technology evolves and, thus, many of the elements are exemplary in nature and should not be interpreted to limit the scope of the embodiments.

Specific details are given in the description to provide a thorough understanding of the embodiments. However, it will be understood by one of ordinary skill in the art that the embodiments may be practiced without these specific details. For example, well-known processes, structures, and techniques have been shown without unnecessary detail in order to avoid obscuring the embodiments.

Also, it is noted that the embodiments may be described as a process which may be depicted as a flow diagram or block diagram or as stages. Although each may describe the operations as a sequential process, many of the operations can be performed in parallel or concurrently. In addition, the order of the operations may be rearranged. A process may have additional stages not included in the figure.

Having described several embodiments, it will be recognized by those of skill in the art that various modifications, alternative constructions, and equivalents may be used without departing from the spirit of the different embodiments. For example, the above elements may merely be a component of a larger system, wherein other rules may take precedence over or otherwise modify the application of the different embodiments. Also, a number of stages may be undertaken before, during, or after the above elements are considered. Accordingly, the above description should not be taken as limiting the scope of the different embodiments.

What is claimed is:

1. A method comprising:

inserting a soap bar that is wet through an opening into a container, wherein the container includes one or more vapor-permeable layers;

closing the opening of the container; and drying the soap bar through water vapor passing through the one or more vapor permeable layers of the container.

2. The method of claim 1, wherein closing the opening of the container includes:

folding a portion of the container that includes the opening of the container to form a fold-top closure; and coupling a first buckle component coupled with the container with a second buckle component coupled with the container to maintain the fold-top closure.

3. The method of claim 1, further comprising removing the soap bar from the container after the soap bar has dried.

4. The method of claim 1, wherein the one or more vapor-permeable layers include one or more flexible laminar sheets.

5. The method of claim 4, wherein the one or more flexible laminar sheets include one or more thermoplastic urethane coated fabrics.

6. The method of claim 5, wherein the one or more thermoplastic urethane coated fabrics includes one or more polyether-based thermoplastic urethane coated fabrics.

7. The method of claim 6, wherein the one or more polyether-based thermoplastic urethane coated fabrics is configured to contain a wet residue of the soap bar within the container.

8. The method of claim 1, wherein one or more vapor-permeable layers include one or more non-resilient layers.

9. The method of claim 1, wherein one or more vapor-permeable layers include a first layer and a second layer that are bonded with each other along a first side of the first layer and a first side of the second layer and along a second side of the first layer and a second side of the second layer.

10. The method of claim 9, wherein the one or more vapor-permeable layers include a third layer that forms a gusset component of the container between a third side of the first layer and a third side of the second layer.

11. The method of claim 9, wherein the first layer of the container and the second layer of the container are bonded with each other to form a flatten configuration before the soap bar that is wet is placed within the container.

12. The method of claim 1, wherein the container is configured with respect to one or more vapor-permeable layers such that drying the soap bar occurs in less than 24 hours.

13. The method of claim 9, wherein the first layer of the container and the second layer of the container are limited to a length of 18 centimeters or less and a width of 12.5 centimeters or less.

14. The method of claim 1, wherein the one or more vapor-permeable layers include one or more water-proof layers.

15. The method of claim 2, wherein the fold-top closure includes one or more semi-rigid structural members to form a liquid-tight barrier.

16. The method of claim 1, wherein the one or more vapor-permeable layers includes an external hydrophobic coating.

17. The method of claim 16, wherein the external hydrophobic coating includes a durable water repellant (DWR).

18. The method of claim 6, wherein the one or more polyether-based thermoplastic urethane coated fabrics are configured such that a polyether-based thermoplastic urethane coating coats an internal layer of the one or more fabrics.

19. The method of claim 9, wherein the first layer of the container and the second layer of the container each have a length between 14 centimeters and 16 centimeters and a width between 9 centimeters and 11 centimeters.

20. The method of claim 1, wherein the container forms a total volume between 200 milliliters and 300 milliliters.

* * * * *